US008058788B2

(12) United States Patent
Bupp et al.

(10) Patent No.: US 8,058,788 B2
(45) Date of Patent: Nov. 15, 2011

(54) LAMP BASE

(75) Inventors: Neil Bupp, Manchester, PA (US); Tad Smith, Manchester, PA (US); Donald Burger, York, PA (US); Jesse Unger, Dover, PA (US)

(73) Assignee: Osram Sylvania Inc., Danvers, MA (US)

( * ) Notice: Subject to any disclaimer, the term of this patent is extended or adjusted under 35 U.S.C. 154(b) by 342 days.

(21) Appl. No.: 12/229,432

(22) Filed: Aug. 22, 2008

(65) Prior Publication Data

US 2009/0033199 A1 Feb. 5, 2009

(51) Int. Cl.
*H01J 5/48* (2006.01)

(52) U.S. Cl. ..... 313/318.01; 313/315

(58) Field of Classification Search ..... 313/315–316, 313/318.01–318.05

See application file for complete search history.

(56) References Cited

U.S. PATENT DOCUMENTS

| | | | | |
|---|---|---|---|---|
| 2,993,192 | A * | 7/1961 | Mouat | 439/662 |
| 4,003,624 | A * | 1/1977 | Smith | 439/662 |
| 4,029,387 | A * | 6/1977 | Eager | 439/662 |
| 4,866,331 | A * | 9/1989 | Livera | 313/318.03 |
| 5,568,009 | A * | 10/1996 | Gandhi | 313/318.01 |
| 6,255,763 | B1 * | 7/2001 | Wright | 313/318.04 |

FOREIGN PATENT DOCUMENTS

DE 4219044 A1 * 12/1993

* cited by examiner

*Primary Examiner* — Nimeshkumar D. Patel
*Assistant Examiner* — Donald Raleigh
(74) *Attorney, Agent, or Firm* — William H. McNeill

(57) ABSTRACT

A method of manufacturing a flash-free lamp base (10), wherein the lamp base (10) comprises a shell (14), an eyelet (16) and a glass, electrically insulating part (18) therebetween and joining the shell (14) and the eyelet (16), the shell and the eyelet being electrically conductive, the shell (14) having a tubular portion (14*a*) with an open end (14*b*) and a partially closed end (14*c*) defining a volume (14*d*) therebetween, the partially closed end (14*c*) including a tapered area (14*e*) terminating in a reentrant section (14*f*) that extends into the volume (14*d*) and defines an inner annulus (14*g*). The method of making the base comprises the steps of positioning the shell (14) and the eyelet (16) at a workstation (19) in spaced, axial alignment with one another defining a gap therebetween; actuating a first forming tool (20) through the tubular portion (14*a*) and into engagement with the tapered area (14*e*) and the inner annulus (14*g*); dispensing a quantity of molten glass (32) into the gap; and actuating a second forming tool (22) within the first forming tool 20 to form the molten glass 32 into an electrically insulating part 18 between the shell (14) and the eyelet (16). The base so formed is free from extraneous glass flashing and thereby provides a base less likely to contaminate the lamp manufacturing process.

2 Claims, 6 Drawing Sheets

LAMP BASE

CROSS-REFERENCE TO RELATED APPLICATION

This application claims priority from Provisional Patent Application No. 60/674,056, filed Apr. 22, 2005.

TECHNICAL FIELD

This invention relates generally to lamp bases and particularly to lamp bases that are free from glass flashing and to a method for making such lamp bases.

BACKGROUND ART

Lamp bases provide the support for internal lamp components and the electrical connection to those internal components. The usual lamp base associated with the common incandescent lamp, as well as other types of lamp, comprises two electrically conductive portions (a shell and an eyelet) joined by an electrically insulating portion of glass. The shell portion contains means for mating with a socket and, generally, this means comprises a series of threads.

For many years these lamp bases have been manufactured by an automated process whereby the shell and eyelet were positioned at a work station in a spaced apart manned and molten glass was inserted into the space between the shell and the eyelet. A forming tool was inserted into the shell to form the glass, leaving an aperture for a connecting wire to subsequently be inserted to make electrical connection to the eyelet. The shell was formed with an internal annulus about which the glass was adhered.

While this process has been used with great success, a problem has existed with excess glass being deposited within the shell and about the internal annulus. This excess glass is known as flashing and, during subsequent shipping of the bases to customers, the flashing, in the form of glass chips, can break off and cause later contamination in the lamp-making process.

DISCLOSURE OF INVENTION

It is, therefore, an object of the invention to obviate the disadvantages of the prior art.

It is another object of the invention to enhance lamp bases.

These objects are accomplished, in one aspect of the invention, by a base comprising: a first electrically conductive part, a second electrically conductive part and a glass, electrically insulating part therebetween and joining the first part and the second part, the improvement wherein: the first conductive part has a tubular portion with an open end and a partially closed end defining a volume therebetween, the partially closed end including a tapered area terminating in a reentrant section that extends into the volume and defines an inner annulus, the inner annulus being free from glass flashing whereby no glass particles inhabit the volume.

The base are manufactured by a method of manufacturing a flash-free lamp base wherein the lamp base comprises a first part, a second part, and a glass, electrically insulating part therebetween and joining the first part and the second part, the first part and the second part being electrically conductive, the first part having a tubular portion with an open end and a partially closed end defining a volume 1 therebetween, the partially closed end including a tapered area terminating in a reentrant section that extends into the volume and defines an inner annulus, the steps comprising: positioning the first part and the second part at a workstation in spaced, axial alignment with one another defining a gap therebetween; actuating a first forming tool through the tubular portion and into engagement with the tapered area and the inner annulus; dispensing a quantity of molten glass into the gap and actuating a second forming tool within the first forming tool to form the molten glass into an electrically insulating part between the first part and the second part.

The employment of the dual forming tools insures that no excess glass is deposited internally of the shell, thereby obviating the condition caused by the breaking away of the unwanted and undesirable flashing.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
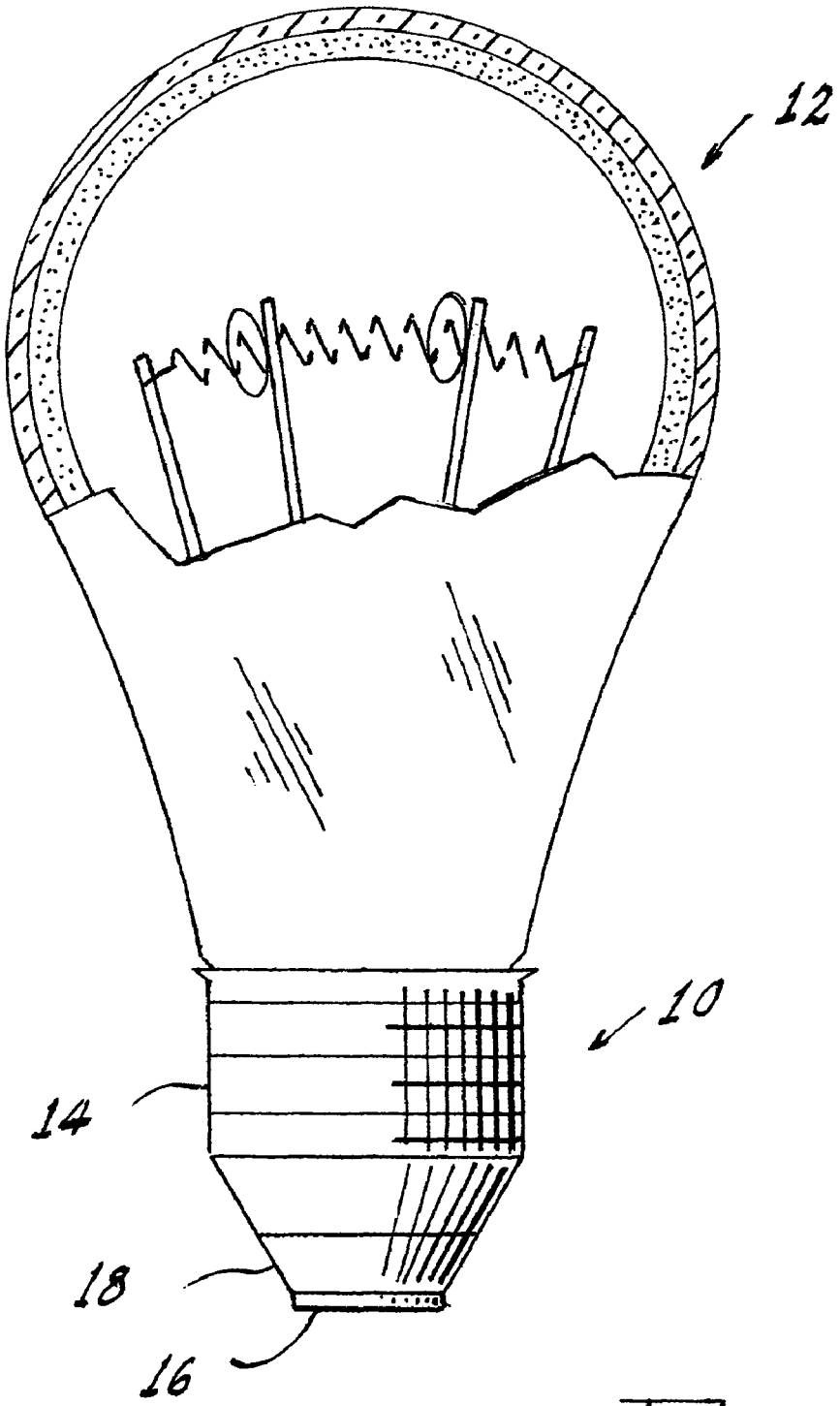
FIG. 1 is an elevational, sectional view of a lamp that can utilize the invention.

Referring now to the drawings with greater particularity, there is shown in FIG. 1 an incandescent lamp 12 having a base 10 that comprises a shell 14, an eyelet 16 and a glass, electrically insulating part 18 therebetween and joining the shell 14 and the eyelet 16. The shell 14, and the eyelet 16, are electrically conductive, and can be formed from any suitable material, for example, aluminum or brass or a combination thereof, as is known.

Figure 2:
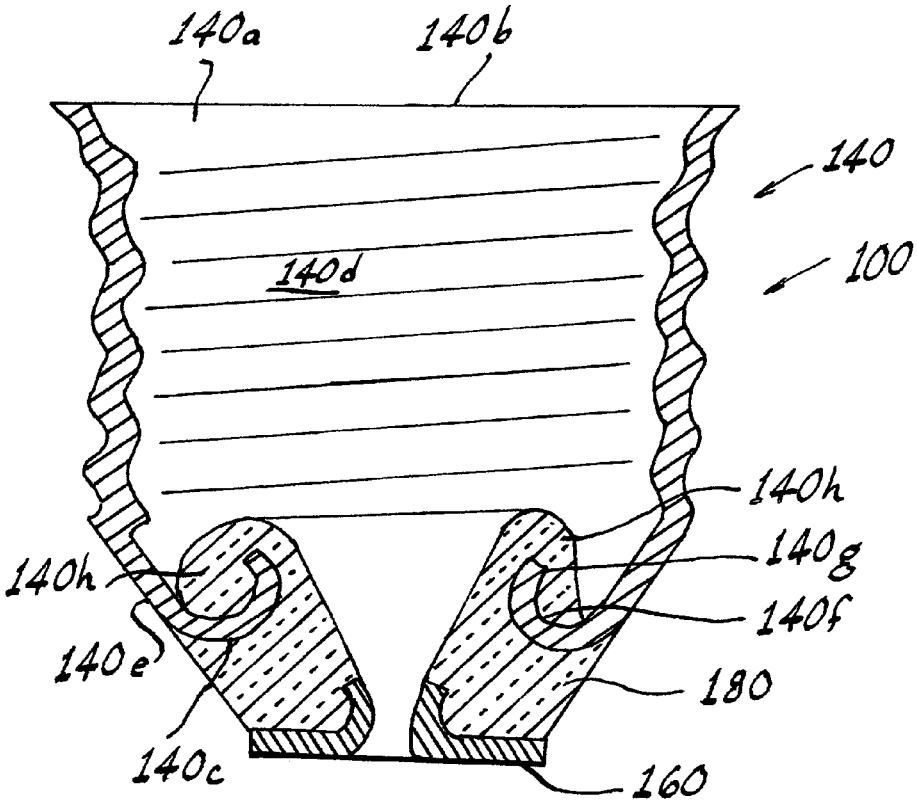
Fig 2 PRIOR ART
FIG. 2 is an enlarged, sectional view of a prior art lamp base.

In FIG. 2 there is shown a prior art lamp base 100 comprised of a shell 140, an eyelet 160 and a glass insulator 180 joining and electrically isolating the shell and the eyelet. The shell 140 has a tubular portion 140*a* with an open end 140*b* and a partially closed end 140*c* defining a volume 140*d* therebetween. The partially closed end 140*c* includes a tapered area 140*e* terminating in a reentrant section 140*f* that extends into the volume 140*d* and defines an inner annulus 140*g*. As shown in the drawing, this prior art lamp base had glass flashing 140*h* that accumulated in the reentrant section 140*f* during the manufacture of the base. This flashing is subject to breaking off during shipment of the bases into particles of glass called "fingernails" and these fingernails can find their way into subsequent lamp making processes and cause substantial down time for the lamp manufacturers.

Figure 3:
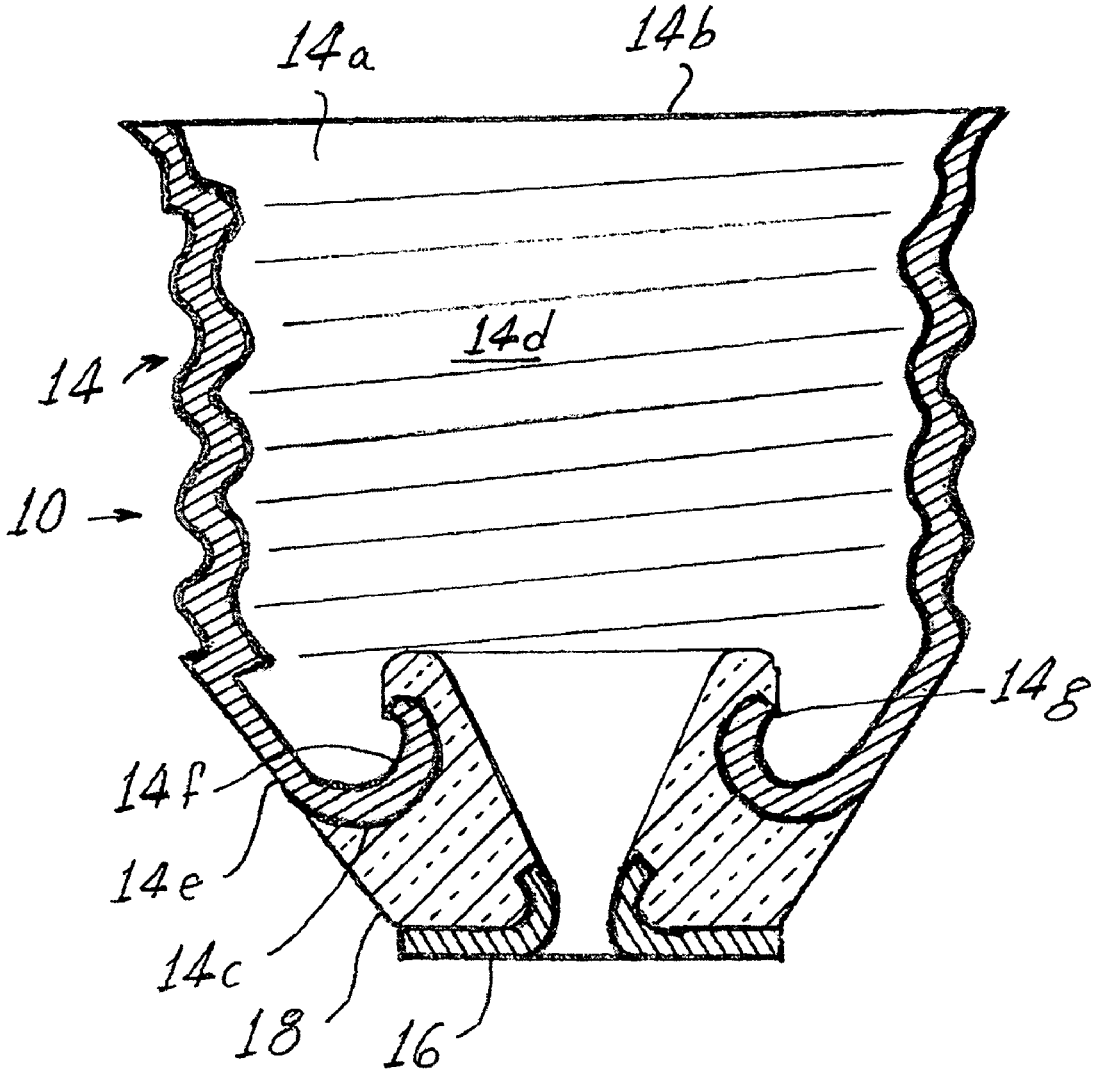
FIG. 3 is a similar view of a lamp base according to an aspect of the invention.

The lamp base 10 shown in FIG. 3 obviates the problem of fingernails. Herein, the lamp base 10 comprises a shell 14, an eyelet 16 and a glass, electrically insulating part 18 therebetween and joining the shell and eyelet into a cohesive assembly. As noted previously, the shell and eyelet are electrically conductive The shell 14 has a tubular portion 14*a* with an open end 14*b* and a closed end 14*c* defining a volume 14*d* therebetween. The partially closed end 14*c* includes a tapered area 14*e* terminating in a reentrant section 14*f* that extends into the volume 14*d* and defines an inner annulus 14*g*. The inner annulus 14*g* is free from glass flashing whereby no glass particles or "fingernails" inhabit the volume 14*d*.

Figure 4:
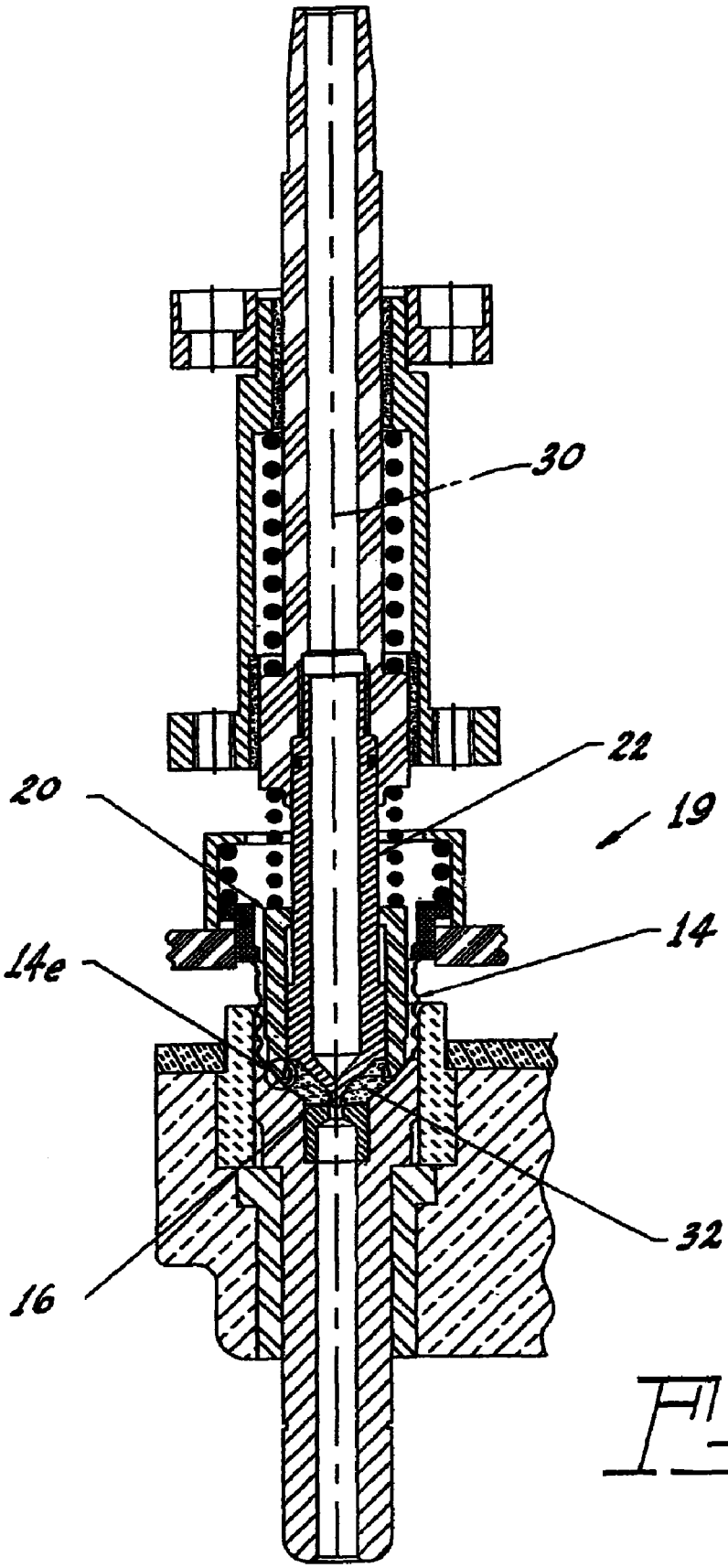
FIG. 4 is an elevational, sectional view of an apparatus for performing the invention.

Fabrication of the flash-free lamp base occurs by positioning the shell and eyelet at a workstation in spaced, axial alignment as shown in FIG. 4. Specifically, the shell 14 and the eyelet 16 are aligned along a vertical axis 30. A first forming tool 20 is actuated along the axis 30 through the tubular portion 14*a* into contact with the tapered area 14*e* and the inner annulus 14*g* of the shell 14.

A given quantity of molten glass 32 is dispensed into the space or gap between the shell 14 and the eyelet 16 and then a second forming tool 22 is actuated along the axis 30 and through the first forming tool 20 to contact and form the molten glass 32 into the desired configuration.

Figure 5:
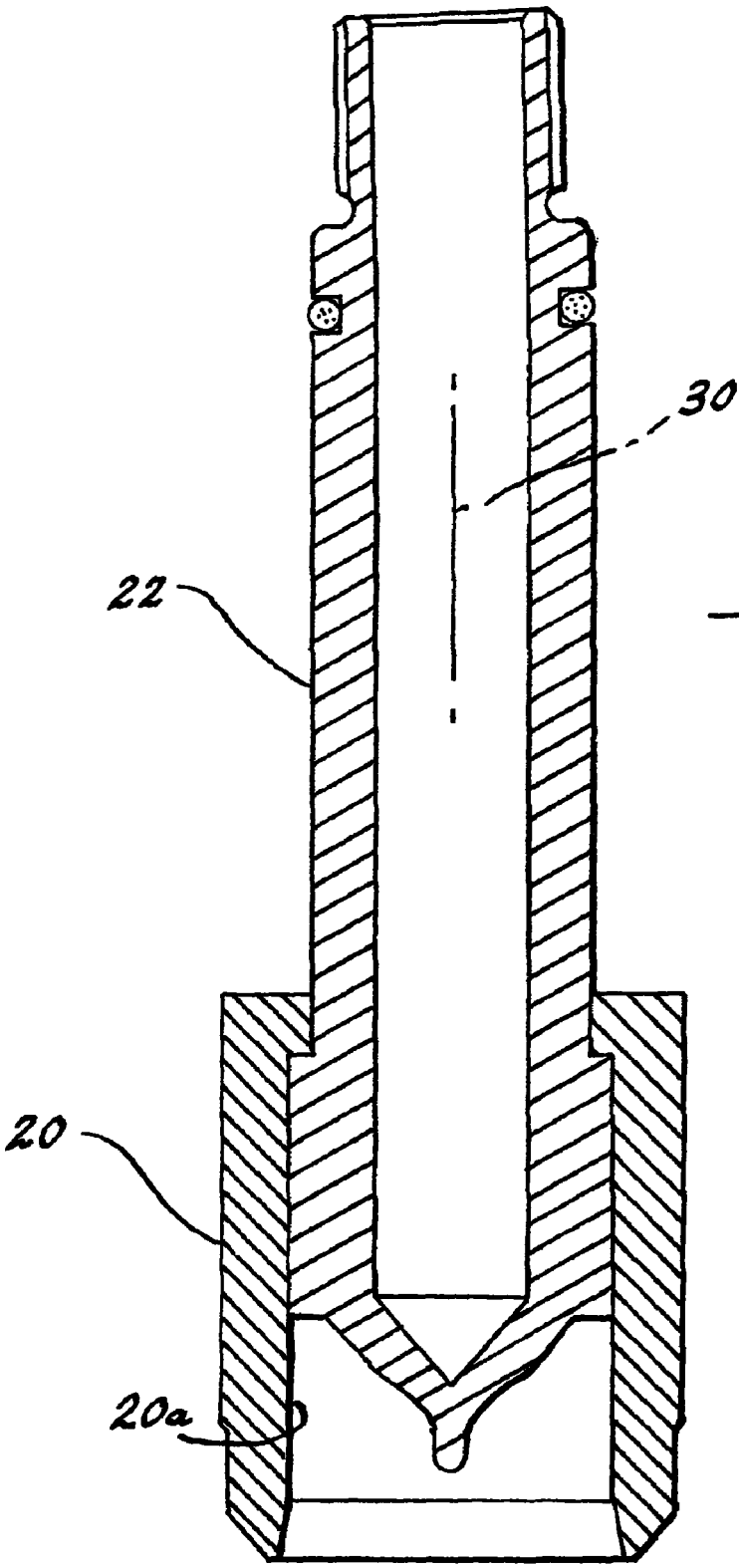
FIG. 5 is an enlarged view of a portion of the apparatus.
Figure 6:
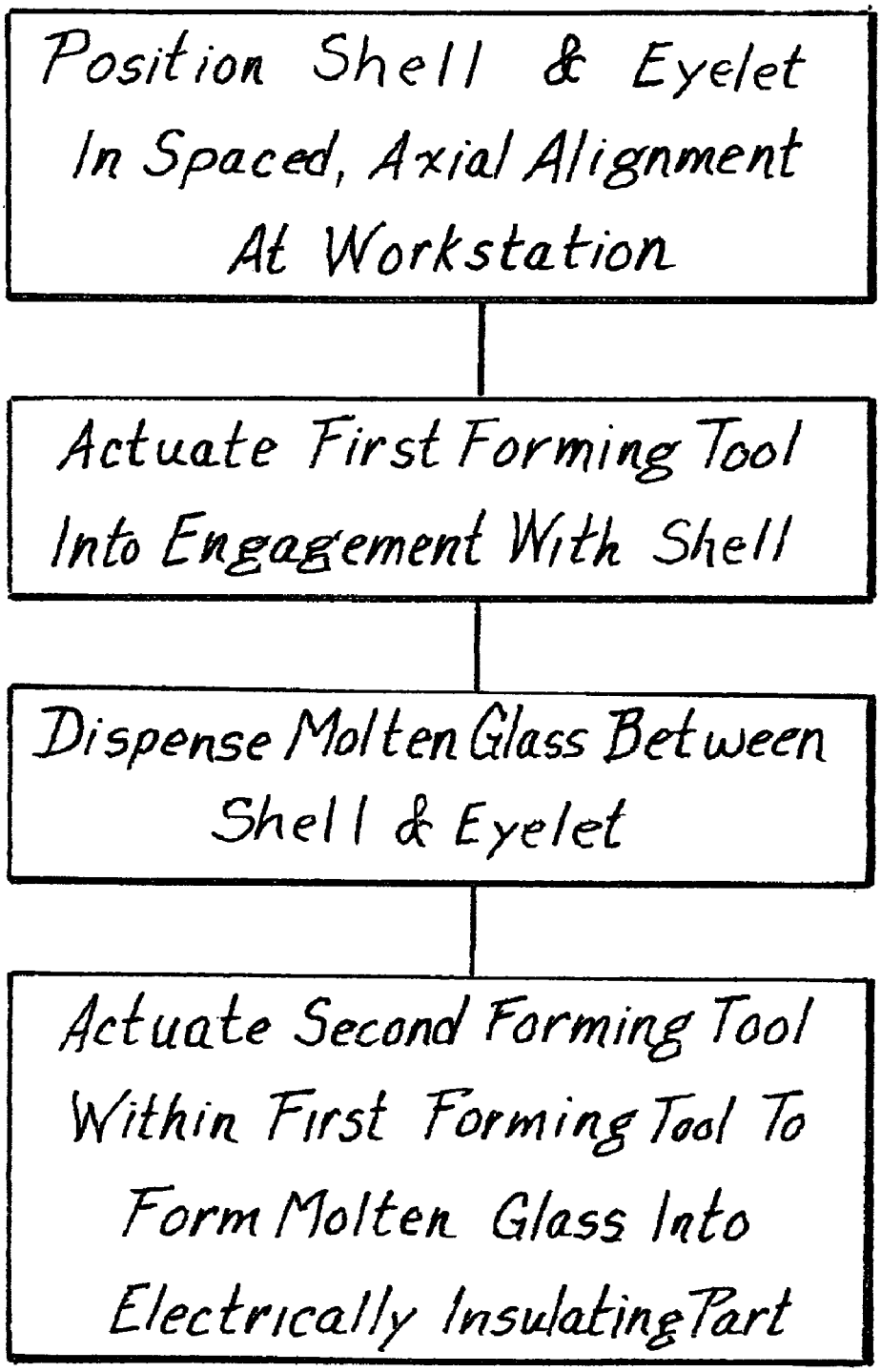
FIG. 6 is a flow chart of the method of performing the invention.

Since the first forming tool 20 has an inside surface 20*a* (see FIG. 5) that fits tightly against the inner annulus 14*g* of the shell 14, the molten glass is completely prohibited from entering the reentrant portion 14*f*. According, there is no flashing to break loose during transportation of the base to a lamp manufacturer and, subsequent processing of the lamp bases onto a lamp envelope proceeds without the danger of fingernails interrupting the smooth flow of the lamp making equipment.

While the invention has been described with reference to threaded lamp bases, it is applicable to other bases such as those designated as bayonet type bases. It is also applicable to all sizes of lamp bases, from candelabra to mogul.

While there have been shown and described what are present considered to be the preferred embodiments of the invention, it will be apparent to those skilled in the art that various changes and modifications can be made herein without departing from the scope of the invention as defined by the appended claims.

What is claimed is:

1. In a lamp base (10) comprising: a shell (14), an eyelet (16) and an electrically-insulating glass part (18) therebetween and joining said shell (14) and said eyelet (16), said shell (14) and said eyelet (16) being electrically conductive, the improvement wherein:

said shell (14) has a tubular portion (14*a*) with an open end (14*b*) and a partially closed end (14*c*) defining a volume (14*d*) therebetween, said partially closed end (14*c*) including a tapered area (14*e*) terminating in a reentrant section (14*f*) that comprises a continuous curve that extends into said volume (14*d*) and defines an inner annulus (14*g*) that projects toward said tapered area (14*e*) whereby said inner annulus (14*g*) has a diameter greater than the inner diameter of the reentrant section (14*f*) that is adjacent to said eyelet (16), said inner annulus (14*g*) and said reentrant section (14*f*) being free from glass flashing (140*h*) whereby no glass particles inhabit said volume.

2. In a lamp base (10) comprising: a shell (14), an eyelet (16) and an electrically-insulating glass part (18) therebetween and joining said shell (14) and said eyelet (16), said shell (14) and said eyelet (16) being electrically conductive and arrayed about an axis (30), the improvement wherein:

said shell (14) has a tubular portion (14*a*) with an open end (14*b*) and a partially closed end (14*c*) defining a volume (14*d*) therebetween, said partially closed end (14*c*) including a tapered area (14*e*) terminating in a reentrant section (14*f*) that comprises a continuous curve that extends into said volume (14*d*) and defines an inner annulus (14*g*) that projects toward said tapered area (14*e*) and away from said axis (30) whereby said inner annulus (14*g*) has a diameter greater than the inner diameter of the reentrant section (14*f*) that is adjacent to said eyelet (16), said inner annulus (14*g*) and said reentrant section (14*f*) being free from glass flashing (140*h*) whereby no glass particles inhabit said volume.

* * * * *